US012654749B2

(12) United States Patent
Isosaki et al.

(10) Patent No.: US 12,654,749 B2
(45) Date of Patent: Jun. 16, 2026

(54) PILLOW BEAM OF RAIL VEHICLE AND RAIL VEHICLE

(71) Applicant: Hitachi, Ltd., Tokyo (JP)

(72) Inventors: Yohei Isosaki, Tokyo (JP); Takashi Miyanaga, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 525 days.

(21) Appl. No.: 18/313,468

(22) Filed: May 8, 2023

(65) Prior Publication Data

US 2023/0406369 A1 Dec. 21, 2023

(30) Foreign Application Priority Data

May 20, 2022 (JP) ..... 2022-083355

(51) Int. Cl.
*B61F 5/52* (2006.01)

(52) U.S. Cl.
CPC ..... *B61F 5/52* (2013.01)

(58) Field of Classification Search
CPC ..... B61F 1/14; B61F 1/12; B61F 1/10; B61F 5/10; B61F 5/526; B61F 1/08; B61F 5/52
See application file for complete search history.

(56) References Cited

U.S. PATENT DOCUMENTS

2023/0406369 A1* 12/2023 Isosaki ..... B61F 5/52

FOREIGN PATENT DOCUMENTS

| | | | | | |
|---|---|---|---|---|---|
| CN | 102107349 | A | * | 6/2011 | |
| CN | 203612009 | U | * | 5/2014 | |
| CN | 106043344 | A | * | 10/2016 | ..... B61F 5/24 |
| EP | 2 500 231 | B1 | | 7/2015 | |
| EP | 2 540 592 | B1 | | 7/2015 | |
| EP | 3653464 | A1 | * | 5/2020 | ..... B61F 1/12 |
| JP | 2020059466 | A | * | 4/2020 | |
| WO | WO-2018225442 | A1 | * | 12/2018 | ..... B61F 5/10 |
| WO | WO-2023281558 | A1 | * | 1/2023 | ..... B61F 5/10 |

* cited by examiner

*Primary Examiner* — Paul N Dickson
*Assistant Examiner* — Maxwell L Meshaka
(74) *Attorney, Agent, or Firm* — Foley & Lardner LLP

(57) ABSTRACT

A rail vehicle's pillow beam (9) has a plurality of radial ribs (20) radially disposed, horizontally oriented, projecting shapes on a flat plate surface arranged radially from the center of the vertical load input (17) and curvature provided along the longitudinal or width direction of the vehicle, gradually curving along the longitudinal or width direction of the vehicle as it moves away from the center of the vertical load input, and a plurality of circular ribs (21) arranged intermittently around the vertical load input seating surface so as to overlap the plurality of radial ribs (20).

9 Claims, 7 Drawing Sheets

PILLOW BEAM OF RAIL VEHICLE AND RAIL VEHICLE

BACKGROUND OF THE INVENTION

1. Field of the Invention

The invention relates to a structural member of a rail vehicle and to a rail vehicle, in particular to a pillow beam of a rail vehicle capable of securing a space between a pillow beam and a bogie frame, and to a rail vehicle equipped therewith.

2. Description of the Related Art

In general, a vehicle body (sometimes referred to as a body structure) is a six-sided structure consisting of a bogie frame that forms the floor, side structures located at both ends of the bogie frame in the width direction, a gable structure located at both ends of the longitudinal direction of the bogie frame, and a roof structure located above the side and gable structures.

The bogie frame has a side beam provided along the longitudinal direction at both ends of the bogie frame in the width direction, an end beams connecting both ends of the side beams in the longitudinal direction, a pillow beam provided along the end beam at a predetermined distance from the longitudinal end of the body structure, and a middle beam positioned along the longitudinal direction of the body structure to connect the end beams and pillow beam to the body structure.

A center pin provided along the vertical direction of the structure under the pillow beam is connected to the bogie frame. During vehicle acceleration and deceleration, the center pin transfers the load from the cart to the pillow beam in the front-rear direction.

On the other hand, from the viewpoint of improving the assembly of rail vehicles, it is required to facilitate the installation of wiring and ducts that are installed under the floor. In order to facilitate installation, it is effective to assemble a certain space between the bogie frame and the pillow beam to the body structure while the pillow beam is attached to the cart. As a bogie structure with such a pillow beam, Patent documents 1 and 2 propose a bogie with a pillow beam that is bolted only to the side beam.

CITATION LISTS

Patent document 1: EP2 500 231A
Patent document 1: EP2 540 592A

SUMMARY OF THE INVENTION

Technical Problem

In the bogie frame structure of a rail vehicle, moment loads transmitted from the cart to the pillow beam via the center pin cause torsional deformation of the pillow beam. In addition, vertical loads are transmitted from the cart through the air springs due to vertical vibration during driving and the weight of the vehicle and passengers. This causes bending deformation of the pillow beam. It is necessary to ensure sufficient strength of the pillow beams against such moments and vertical loads to avoid excessive stress concentration. In the bogie structure with a pillow beam described in Patent Documents 1 and 2, the pillow beam structure consists of ribs and face plates with a uniform cross-section along the width direction of the vehicle body, which increases the weight of the pillow beam and may limit the size of the space between the pillow beam and the bogie frame.

The purpose of the present invention is to provide a rail vehicle which constitutes a pillow beam with a thin structural member that contributes to improved assembly of the car body and has light weight, high rigidity, and sufficient strength, and which constitutes a floor surface with a base frame structure equipped with such a structural member.

Solution to Problem

An aspect of the rail vehicle that solves the above-mentioned purpose. The rail vehicle has a body structure (1) which has a bogie frame (3) which extends longitudinally and forms the floor, a side structure (4) located at end of the bogie frame, a gable structure (5) located at longitudinal end of the bogie frame, a roof structure (6) located above the side and gable structures, a cart (2) mounting the body structure, a pillow beam (9) corresponding to the position of the cart (2) in longitudinal direction of the rail vehicle (100) and located under the bogie frame (3), a plurality of buffer members (14) which receive vertical loads from the bogie frame (3) to the cart (2). The pillow beam of the rail vehicle (100) has a plurality of radial ribs (20) and a plurality of circular ribs (21). The plurality of radial ribs are arranged radially from a center of the vertical load input area (17) of the pillow beam (9). The plurality of radial ribs have projecting shape on a face of a flat placed horizontally on the pillow beam. Each of the plurality of radial ribs has a curvature provided to follow a longitudinal or width direction of the rail vehicle gently as the plurality of ribs move away from the center of the vertical load input area. The plurality of circular ribs (21) intermittently arranged around a seating surface of the vertical load input area to overlap the plurality of radial ribs.

Advantage

According to the rail vehicle that consists of a floor with a structural member and a bogie frame structure equipped with the structural member, it is possible to reduce weight and thickness while maintaining the strength and rigidity of the structural member against vertical loads and moment loads. In particular, when the present invention is applied to a pillow beam, it is possible to provide a pillow beam structure and a rail vehicle with improved assembly performance by securing a predetermined space between the pillow beam and the bogie frame as a result of weight reduction and thinning while maintaining strength and rigidity.

DETAILED DESCRIPTION OF THE PREFERRED EMBODIMENTS

It relates to a structure in which a certain space is provided between the bogie frame and the pillow beam, and the pillow beam is bolted to the side beam and the middle beam. The embodiments are described below with reference to the drawings. The direction of travel or longitudinal direction (front-back) of rail vehicle 100 is the X direction, the width direction (left-right) of rail vehicle 100 is the Y direction, and the height direction (up-down) of rail vehicle 100 is the Z direction. Hereafter, they may be referred to simply as the X direction, Y direction, and Z direction.

Embodiment 1

Figure 1:
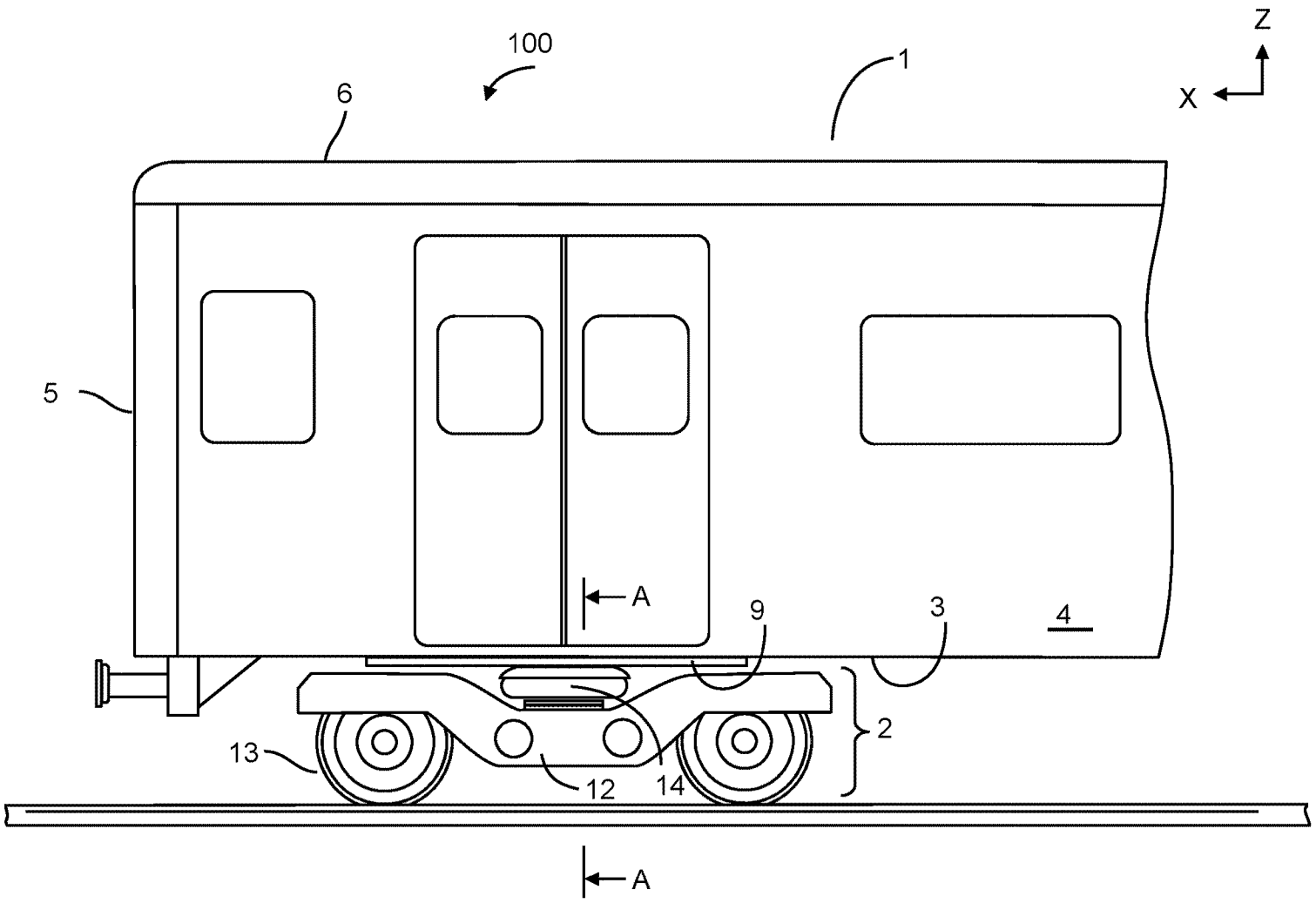
FIG. 1 shows a side view of a rail vehicle with a bogie frame structure with a pillow beam as a floor surface in embodiment 1.
Figure 2:
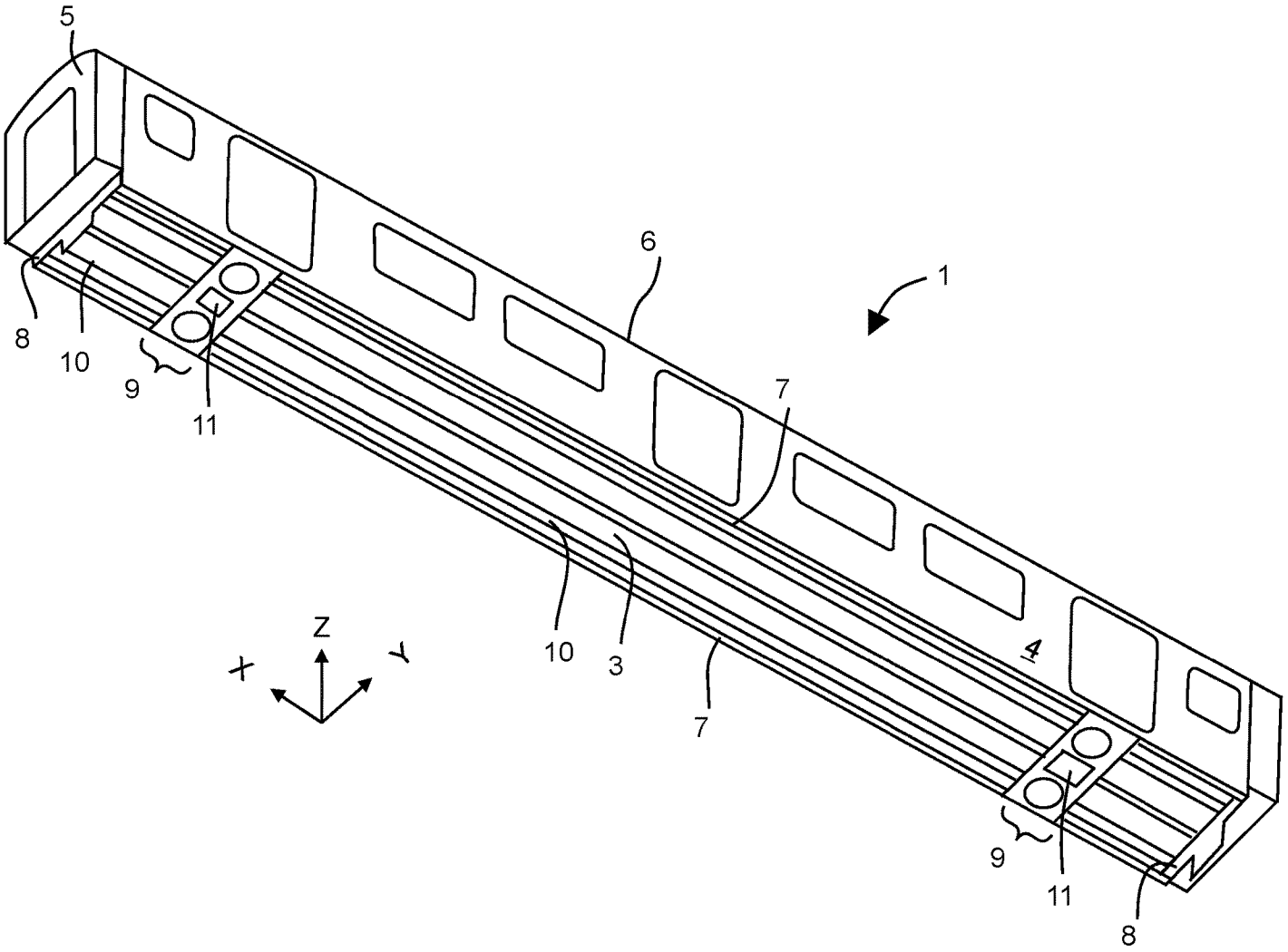
FIG. 2 is an oblique view of the underside of the vehicle body that constitutes the floor with a bogie frame structure with a pillow beam in embodiment 1.
Figure 3:
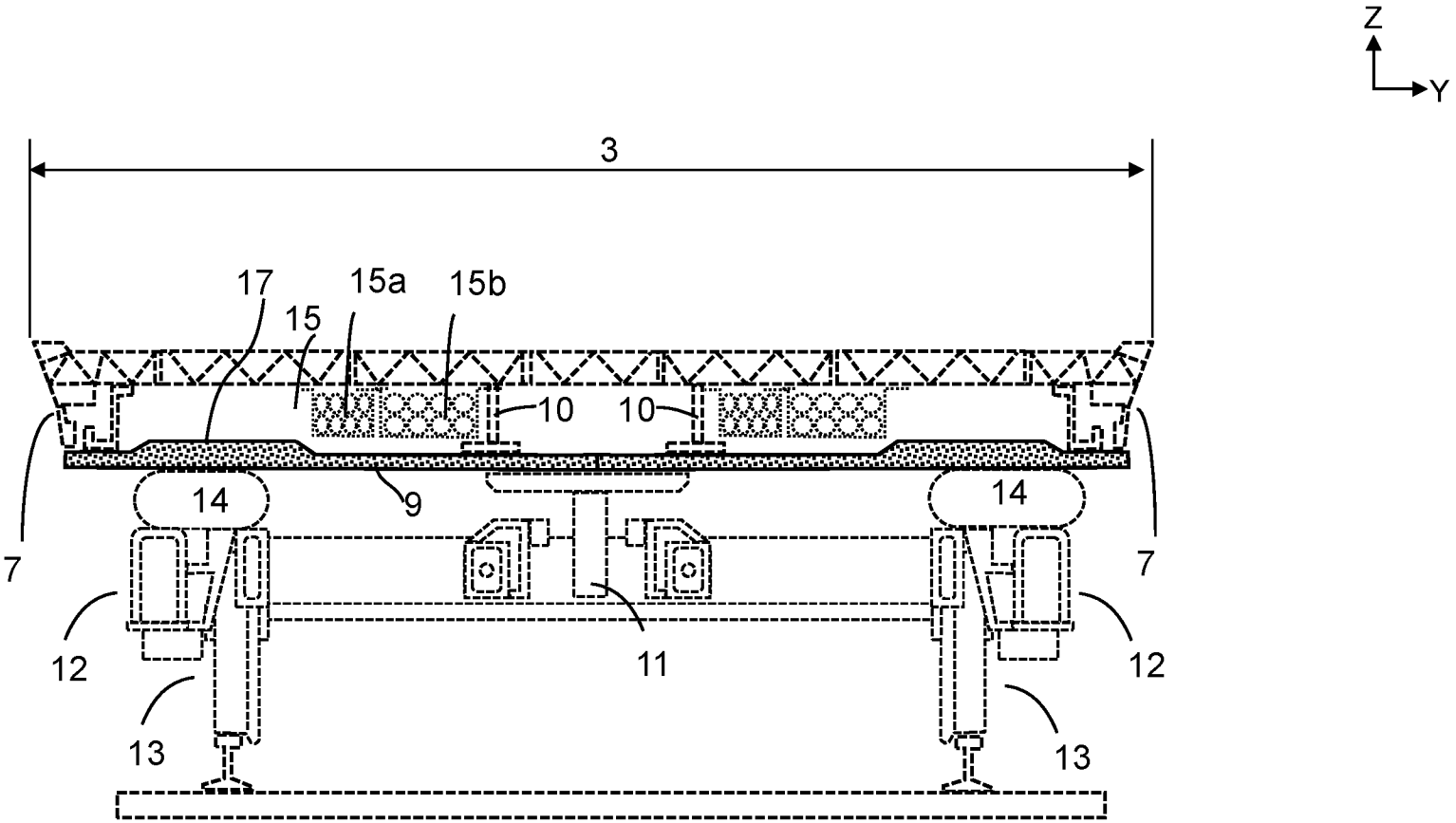
FIG. 3 shows a cross-sectional view of the positional relationship between the bogie frame and the cart with the pillow beam in Embodiment 1.

FIG. 1 shows a side view of rail vehicle 100 of embodiment 1. FIG. 2 shows a bottom side view of vehicle body 1 of embodiment 1. FIG. 3 shows the A-A section of FIG. 1.

The rail vehicle 100 has a body structure 1 and a cart 2 that carries the body structure 1.

The body structure 1 is a six-sided structure consisting of a bogie frame 3 that forms the floor, a pair of side structures 4 located at both ends of the bogie frame 3 in the width direction, a pair of gable structure 5 located at both ends of the longitudinal direction of the bogie frame, and a roof structure 6 located above the side structure 4 and gable structure 5. The side structure 4 is equipped with windows and side sliding doors for passengers to get in and out.

Bogie frame 3 is a planar structure consisting of a perimeter with end beams 8 provided at both ends in the x-direction and side beams 7 provided at both ends in the y-direction of bogie frame 3, and a floor structure with this perimeter as the outer edge. The bogie frame 3 has a pair of pillow beams 9 provided along the y-direction at the site supported by the cart 2. One end beam 8 is connected to the other pillow beam 9 by a pair of middle beams 10 along the x-direction.

The bogie frame 3 has side beam 7, end beam 8, pillow beam 9, and middle beam 10. The side beam(s) 7 are provided along the longitudinal direction (X-direction) at both ends of the bogie frame 3 in the width direction (Y-direction). The end beam 8 connects both ends of side beams 7 in the longitudinal direction (X-direction). The pillow beam 9 is provided along the width direction (Y-direction) of the bogie frame 3 at a predetermined distance from the longitudinal (X-direction) end of the body structure 1. The middle beam 10 is positioned along the longitudinal direction (X-direction) of the body structure 1 so as to connect the end beam 8 and the pillow beam 9. The pillow beam 9 supports the weight of the body structure 1 and rotates the rail vehicle 100.

The cart 2 is positioned below the pillow beam 9 and is provided with the bogie frame 3 rotatable to the bogie frame 3 around the center pin 11 along the Z direction in the horizontal plane. The cart 2 is provided with a cart frame 12 and a wheel 13 fixed to both ends of an axle held rotatably to the cart frame 12. The cart 2 supports the bogie frame 3 via air springs (buffer members) 14 provided on both sides in the Y direction near the center of the X direction of the cart. The air springs receive vertical loads from the bogie frame 3 to the cart 2.

The center pin 11 provided along the vertical direction of the body structure 1 on the underside of the pillow beam 9 is connected to the cart frame 12 (See FIG. 3). The load is transmitted from the cart 2 to the pillow beam 9 via the center pin 11 in the front-back direction of the vehicle.

As shown in FIG. 3, the pillow beam 9 is installed between cart 2 and bogie frame 3.

Space 15 is the space between bogie frame 3 and pillow beam 9. This space 15 can be used as a space 15*a* or 15*b* for various components and parts such as piping, ducts, sensors, and vibration isolators. The thinning of the 9 pillow beams expands the space 15 and facilitates the installation of piping, ducts, sensors, and vibration isolators.

Figure 4:
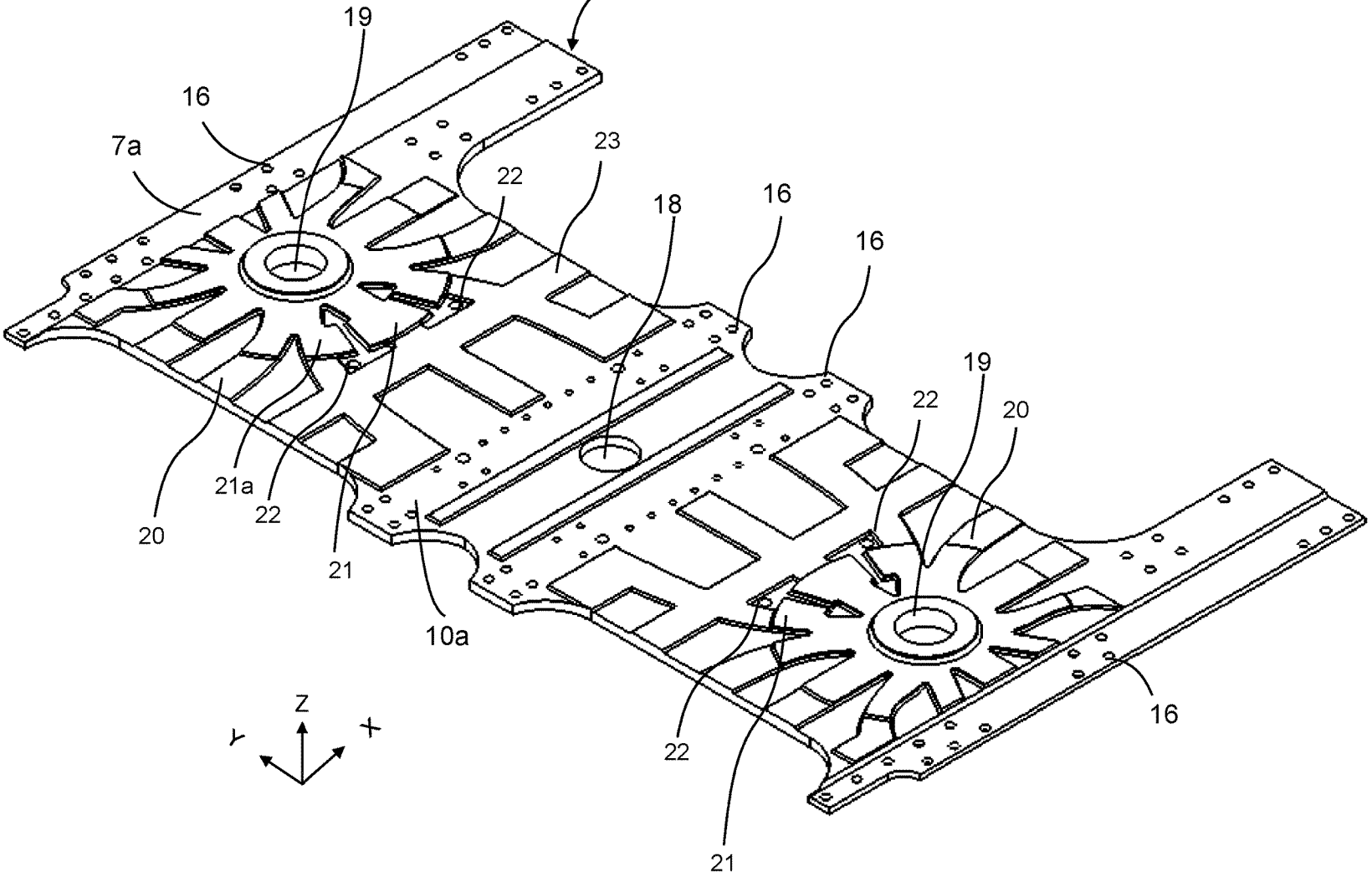
FIG. 4 shows the appearance of the top surface of the pillow beam in Embodiment 1.
Figure 5:
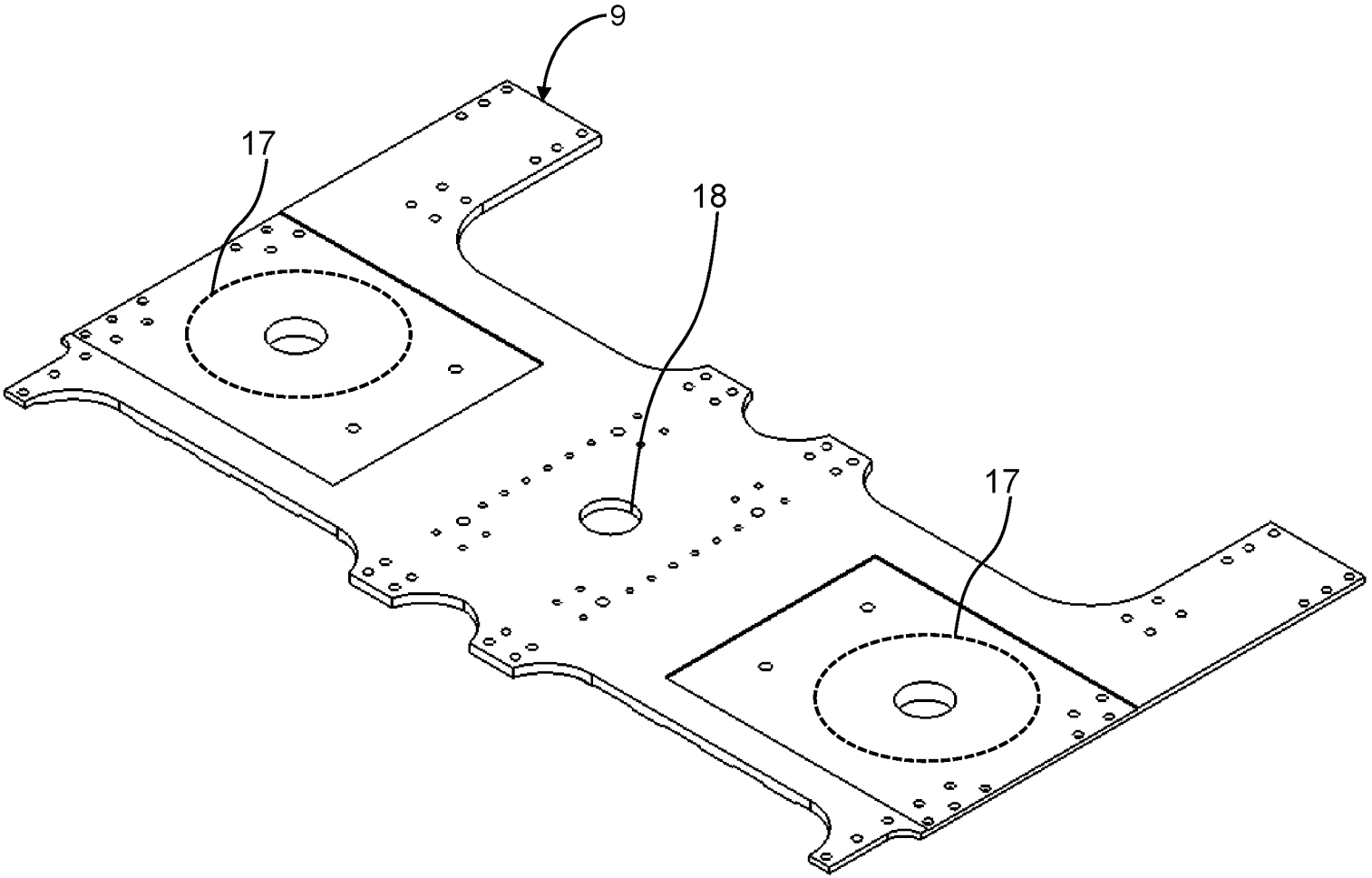
FIG. 5 shows the appearance of the underside of the pillow beam in Embodiment 1.

FIG. 4 shows the top view of pillow beam 9 shown as embodiment 1, and FIG. 5 shows the bottom view of pillow beam 9 shown as embodiment 1.

The connector 16 of the pillow beam 9 is the part that fixes the side beam 7 and middle beam 10 to the pillow beam 9 with bolts, etc. The connector 16 is located at both ends of the body structure 1 in the Y-direction and near the center of the body structure 1, and fixes the side beam 7 and middle beam 10 to the pillow beam 9. The air spring seat 17 (see FIG. 5) of the pillow beam 9 transfers the load to the upper side of the air spring 14 of the cart 2 as a vertical load input part.

The center hole 18 of the pillow beam 9 connects the pillow beam 9 to the center pin 11. Moment loads around the Y direction are input from the center pin 11 around the center hole due to acceleration/deceleration of the rail vehicle, etc. The pillow beam 9 must be rigid against such moment loads.

Pillow beam 9 has two air spring support holes 19, and at the air spring seat 17 (vertical load input area) around each air spring support hole 19, pillow beam 9 is subjected to vertical loads transmitted from air spring 14. The air spring support hole 19 is located at the center of the vertical load input area. In pillow beam 9, strength and rigidity must be maintained against such vertical loads. In addition, the pillow beam 9 has a number of bolt holes for fastening to the side beam 7 and middle beam 10 via bolts, etc.

As shown in FIG. 4, radial ribs 20 are projecting shape on the face of a horizontally oriented flat plate of pillow beam 9 and placed from the air spring support holes 19 on the top surface of the pillow beam 9. As shown in FIG. 4, the radial ribs are provided with a curvature that gradually follows a longitudinal or width direction of the vehicle as the plurality of radial ribs moving away from the center of the vertical load input portion. Radial ribs 20 are provided with curvature in radial rib 20 so that they gradually follow the X or Y direction as it moves away from the air spring support hole 19 located at the center of the vertical load input (air spring seat surface) 17 that supports the air spring 14. In other words, each radial rib 20 is provided radially from the air spring support hole 19 to each edge of the pillow beam 9, and at the position where it intersects each edge of the pillow beam 9, it constitutes a curve that is perpendicular to each edge.

Pillow beam 9 has a side beam joint part 7*a* which are provided along the x-direction at each of ends of the pillow beam 9 in the y-direction and contact the side beams 7, a middle beam contact area 10*a* which is provided along the x-direction at the center of the y-direction of the pillow beam 9 and contacts the middle beam 10, and an air spring contact area provided between the side beam contact 7*a* and the middle beam contact 10*a*.

In the pillow beam 9, the pair of air spring contact areas have a symmetrical shape with the middle beam contact area 10*a* in between. Each of the air spring contact areas has an air spring center 19 in the center corresponding to the center of the air spring 14 provided in the cart 2.

Pillow beam 9 has x-directional ribs (longitudinal ribs) 23 extending in the x-direction at the approximate center position of middle beam contact area 10*a* and vertical load input portion (air spring seat) 17. In other words, the pillow beam 9 has x-directional ribs extending in the x-direction between the middle beam contact area 10*a* at the center of the width direction (y-direction) of the rail vehicle 100 and the vertical load input portion 17 where the air spring 14 as a buffer member contacts.

This arrangement of the radial ribs 20 relieves stress around the air spring support hole 19 against vertical loads and ensures bending rigidity and torsional rigidity against torsional moments, while suppressing increases in plate thickness and weight.

Circular ribs 21 are provided around air spring support hole 19 on the top surface of pillow beam 9, further above the radial rib 20 and overlapping the radial rib 20. Each of the circular rib 21 is an intermittent shape with discontinuous height of the radial rib 20. Each of the circular rib 21 has the same shape as the radial rib 20 around the air spring support hole 19 and increases the height of the peripheral radial rib 20 in the vicinity of the air spring support hole 19. The height of intermittent circular rib 21 should be about twice the height of radial rib 20 alone.

Each of the intermittent circular rib 21 is arranged so that its outer diameter is larger than the outer diameter of the air spring seat 17 (the outer diameter is less than twice the outer diameter of the air spring seat 17) to relieve stress around the air spring support hole 19 and around the air spring seat against vertical loads.

The pillow beam 9 should be configured with intermittent circular ribs 21*a* larger than the width of the corresponding radial ribs 20, because the stress is higher near the straight line connecting the two air spring support holes 19.

In addition to the arrangement of radial ribs 20 and intermittent circular ribs 21, rib in x-direction 23 (x-directional ribs) allows pillow beam 9 to relieve stresses around air spring support hole 19 against vertical loads and to ensure bending stiffness, and to ensure the torsional stiffness against torsional moments. Therefore, the width and thickness (z-direction) of radial rib 20 and circular rib 21 can be suppressed, and X-directional edge rib (longitudinal edge rib) 26 (See FIG. 6) is not necessary in the area 25 near the middle beam contact area 10*a* while increasing in board thickness and weight can be suppressed. In other words, the X-directional edge ribs are not necessary in the area 25 near the middle beam contact area 10*a*. In other words, X-directional edge rib 26 has a notch 25 near center in the width direction (y direction) of pillow beam 9 near middle beam contact area 10*a*.

In the pillow beam 9, it is necessary to drain water that accumulates in the recesses of the radial rib 20 or the intermittent circular rib 21 through the draining hole 22. Since it is difficult to install a drainage hole 22 in the air spring seat 17, water is drained by flowing through the gap between the ribs of the intermittent circular rib 21 to the drainage hole 22 installed outside the air spring seat 17. In particular, the recess between a portion of radial rib 20 and rib in x-direction (longitudinal rib) 23 cannot be drained, so a draining hole 22 is provided.

Embodiment 2

Figure 6:
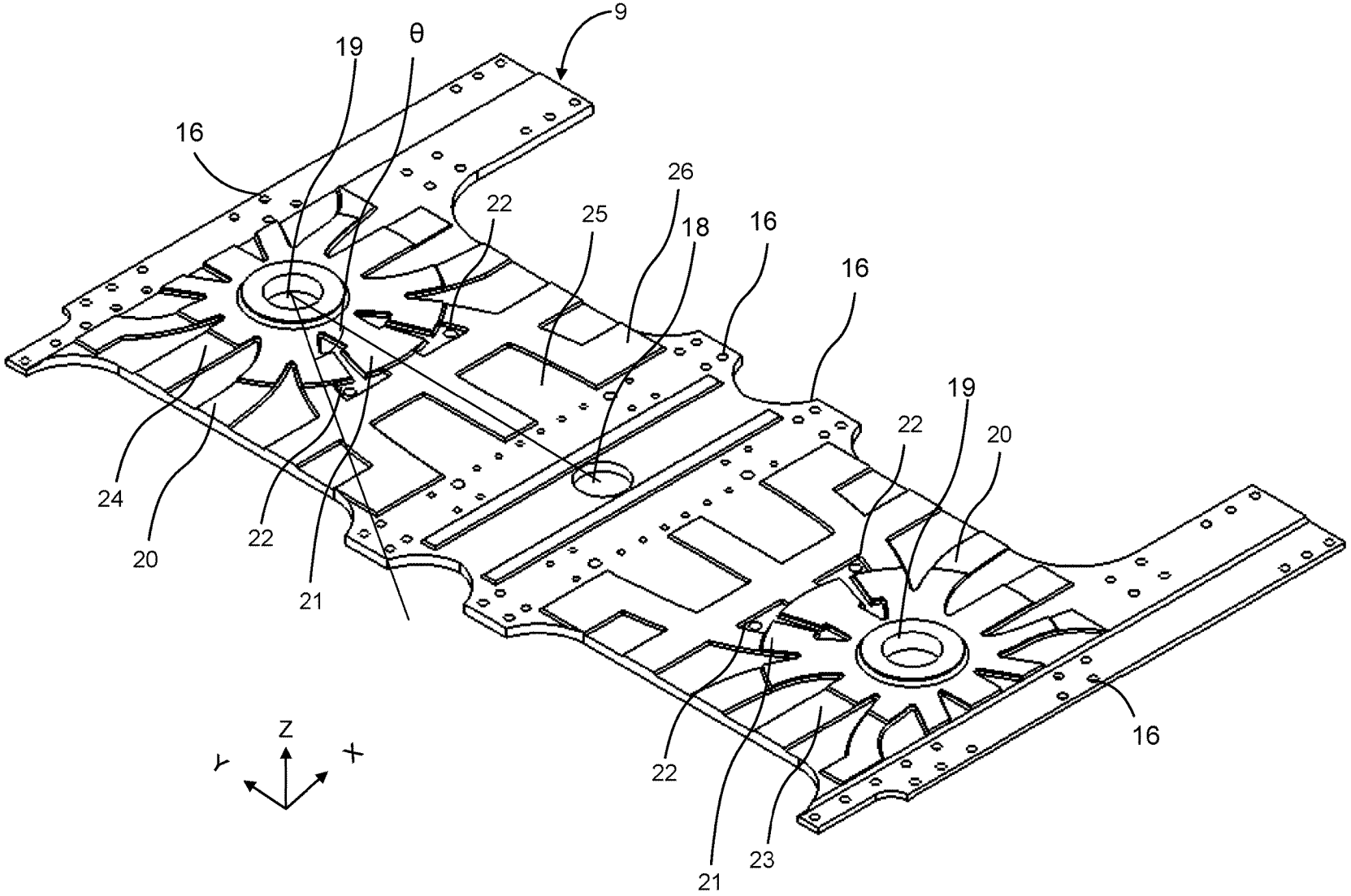
FIG. 6 shows the appearance of the underside of the pillow beam in Embodiment 2.

The pillow beam 9 shown in FIG. 6 as embodiment 2 has the pillow beam structure of embodiment 1 with notch 24 in the intermittent circular rib 21, as shown in the appearance of the pillow beam 9. The stresses and torsional moments around the air spring support hole 19 under vertical loads were analyzed, and it was found that the stresses were higher near the straight line connecting the two air spring support holes 19, and that the stresses and torsional moments were lower at a certain distance in the x direction from the air spring support hole 19. As a result, only radial rib 22 has a notch 24 in the intermittent circular rib 21, in order to relieve stress around the air spring support hole 19 against vertical load and to ensure bending rigidity, and to ensure torsional rigidity against torsional moment, and to suppress the increase in plate thickness and weight.

As shown in FIG. 6, notch 24 is provided at a point that has little effect on the rigidity and strength of the entire pillow beam 9. Specifically, the notch 24 is placed at the center of the two air spring seats (corresponding to the center of the air spring support hole 19) as the origin, and when the direction from the origin to the center of the center pin 11 is 0°, the angle θ with the intermittently placed circular ribs is ±30° or more. In FIG. 6, notch 24 is not provided in radial rib 20 where θ is ±30° or more, but theoretically, notch 24 can be provided in radial rib 20 where θ is ±30° or more, which can further reduce the weight of pillow beam 9.

The shape of the intermittent circular ribs 21 allows for stress relief and bending rigidity around the air spring support hole 19 against vertical loads, and torsional rigidity against torsional moments, while minimizing increases in plate thickness and weight.

Embodiment 3

Figure 7:
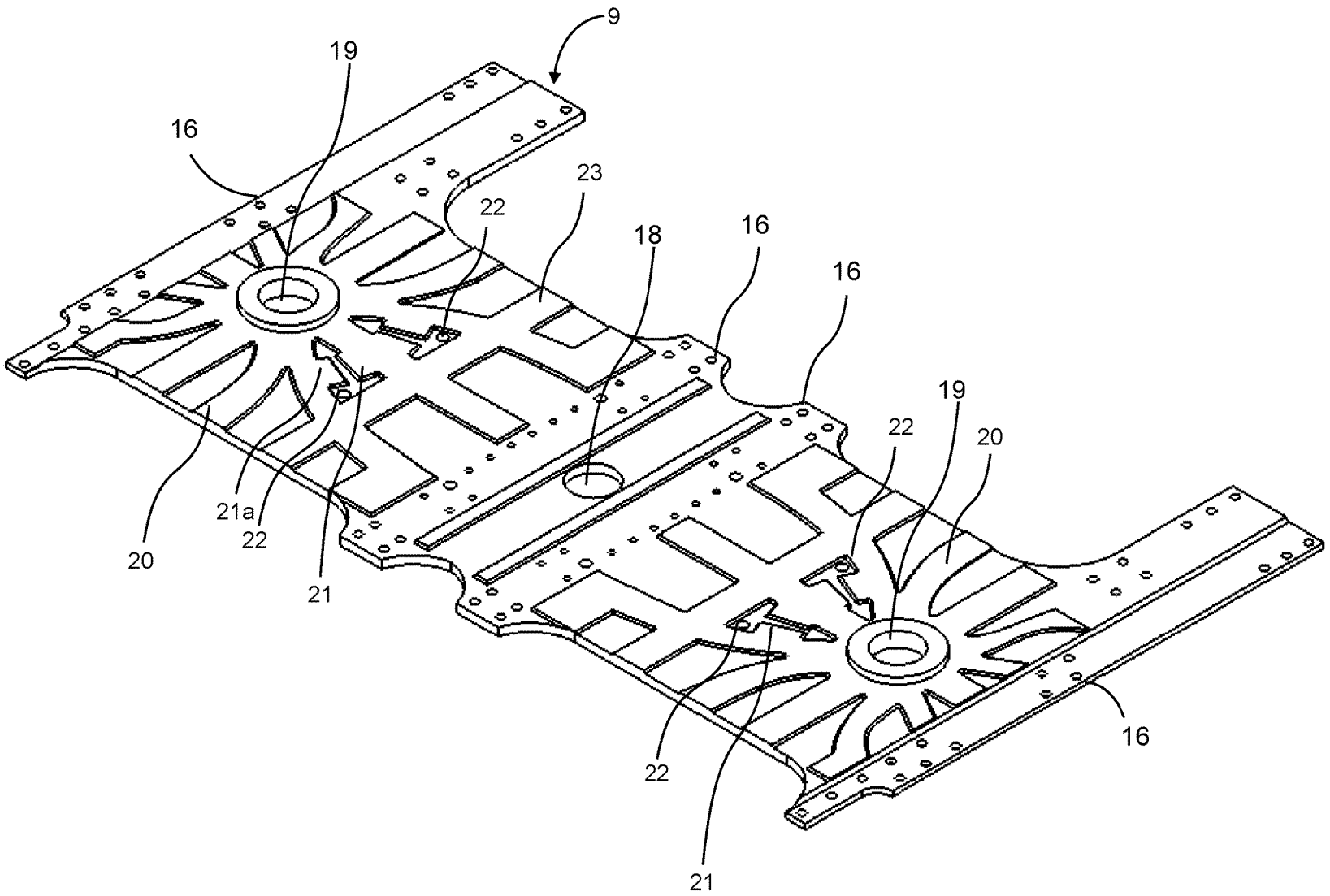
FIG. 7 shows the appearance of the underside of the pillow beam in Embodiment 3.

In FIG. 7, pillow beam 9 of embodiment 3 has radial rib 20 instead of the intermittent circular rib 21 of embodiment 2, with the height of the radial rib 20 decreasing as it moves toward the periphery, centered at air spring support hole 19. The recess bounded by radial rib 20 and rib in x-direction (longitudinal rib) 23 has a draining hole 22 for drainage.

In embodiment 3, in addition to the arrangement of the radial rib 20 and intermittent circular rib 21, the rib in x-direction 23 allows the pillow beam 9 to relieve stresses around the air spring support hole 19 against vertical loads and bending stiffness, and torsional stiffness against torsional moments. This allows for a notch 25 in the x-directional edge rib 26 to deter weight increase.

Since the stress of the pillow beam 9 is higher near the straight line connecting the two air spring support holes 19, if sufficient rigidity can be obtained by making the width of the intermittent circular rib 21*a* larger than the width of the radial rib 20, the height of the radial rib 20 and the intermittent circular rib 21 can be made the same. Such a shape reduces processing costs compared to embodiment 1 and 2.

As explained above, the arrangement of the radial rib 20 and circular rib 21 of the pillow beam 9 reduces the stress around the air spring support hole 19 against vertical loads, ensures bending rigidity, and secures torsional rigidity against torsional moments, all while suppressing increases in plate thickness and weight. This can be achieved while suppressing increases in plate thickness and weight. In addition, the space between the pillow beam 9 and the bogie frame 3 can be secured.

Securing this space makes it easy to place various components and parts such as piping, ducts, sensors, and vibration isolators in the space 15 even after middle beam 10 and pillow beam 9 are bolted together.

What is claimed is:

1. A pillow beam (9) installed in a bogie frame (3) structure that constitutes the floor of a vehicle structure, the pillow beam comprising:

a plurality of radial ribs (20) being arranged radially from an air support hole (19) positioned at a center of a vertical load input portion (17), having a projecting shape on the face of a horizontally oriented flat plate of the bogie frame (3), and provided with a curvature that gradually follows a longitudinal or width direction of the vehicle as the plurality of radial ribs (20) moving away from the center of the vertical load input portion, and a plurality of circular ribs (21) intermittently arranged around the air support hole (19) of the vertical load input, each circular rib of the plurality of circular ribs (21) having an intermittent segment with non-uniform height and positioned above and completely overlapping each radial rib of the plurality of radial ribs (20).

2. A rail vehicle (100) having a body structure (1) which has a bogie frame (3) which extends longitudinally and forms the floor, a side structure (4) located at end of the bogie frame, a gable structure (5) located at longitudinal end of the bogie frame, a roof structure (6) located above the side and gable structures, a cart (2) mounting the body structure, a pillow beam (9) corresponding to the position of the cart (2) in longitudinal direction of the rail vehicle (100) and located under the bogie frame (3), and a plurality of buffer members (14) which receive vertical loads from the bogie frame (3) to the cart (2), wherein the rail vehicle (100) comprising:

wherein the pillow beam (9) has a plurality of radial ribs (20) which is arranged radially from an air support hole (19) positioned at a center of the vertical load input area (17) of the pillow beam (9), has projecting shape on a face of a flat placed horizontally on the pillow beam, and has a curvature provided to follow a longitudinal or width direction of the rail vehicle gently as the plurality of ribs move away from the center of the vertical load input area, and a plurality of circular ribs (21) intermittently arranged around the air support hole (19) of the vertical load input, each circular rib of the plurality of circular ribs (21) having an intermittent segment with non-uniform height and positioned above and completely overlapping each radial rib of the plurality of radial ribs (20).

3. The rail vehicle according to claim 2, wherein the plurality of radial ribs (20) are composed of curves which intersect perpendicularly to each side of the pillow beam.

4. The rail vehicle according to claim 3, wherein the pillow beam (9) has, a middle beam contact area (10*a*) in a center of a width of the rail vehicle, a longitudinal rib (23) extending in a longitudinal direction of the rail vehicle between the vertical load input area (17) and the middle beam contact area (10*a*), and a longitudinal edge rib (26) with a notch (25) near the center of the width of the pillow beam (9) in the vicinity of the middle beam contact area (10*a*).

5. The rail vehicle according to claim 4, wherein an outer diameter of the plurality of circular ribs (21) is larger than an outer diameter of the seating surface of one of the plurality of buffer members in contact with the vertical load input area (17).

6. The rail vehicle according to claim 5, wherein an outer shape of the plurality of circular ribs (21) is less than twice an outer diameter of the seating surface (17).

7. The rail vehicle according to claim 6, wherein the plurality of circular ribs (21) arranged intermittently, has a notch at angles of ±30° or more, when a center of the seating surface is an origin and the direction from the origin to the center of the center pin is 0°.

8. The rail vehicle according to claim 5, wherein the pillow beam, has drainage holes (22) in a portion of the plurality of the radial ribs, and in a portion near the longitudinal rib in a recess surrounded by the longitudinal rib.

9. The rail vehicle according to claim 8, wherein among the plurality of circular ribs (21), a width of the plurality of circular ribs near a straight line connecting the two centers of the seating surfaces is wider than a width of the radial rib.

* * * * *